US006021593A

United States Patent [19]

Hite

[11] Patent Number: 6,021,593

[45] Date of Patent: Feb. 8, 2000

[54] OUTDOOR ADVERTISING SIGN

[76] Inventor: Toni L. Hite, 14516 Waxahachie, Houston, Tex. 77015

[21] Appl. No.: 09/036,420

[22] Filed: Mar. 5, 1998

[51] Int. Cl.[7] ..... G09F 7/02

[52] U.S. Cl. ..... 40/620; 40/595

[58] Field of Search ..... 40/594, 595, 620, 40/618; 434/159, 162, 172

[56] References Cited

U.S. PATENT DOCUMENTS

| | | | |
|---|---|---|---|
| 3,336,682 | 8/1967 | Genin | 40/618 X |
| 3,440,750 | 4/1969 | Toth et al. | 40/618 |
| 4,249,268 | 2/1981 | Berler | 40/586 X |
| 5,136,726 | 8/1992 | Kellin et al. | 2/244 |
| 5,595,829 | 1/1997 | Pitts et al. | 40/595 X |
| 5,680,719 | 10/1997 | Poser | 40/450 |

FOREIGN PATENT DOCUMENTS

| | | | |
|---|---|---|---|
| 2094534 | 9/1982 | United Kingdom | 40/595 |

*Primary Examiner*—Joanne Silbermann

[57] ABSTRACT

A new outdoor advertising sign for displaying advertising letters in a secure manner. The inventive device includes a sign portion including a wooden back portion. The wooden back portion has a metal peripheral frame secured around an outer periphery thereof. The metal peripheral frame has incremental markings on opposed side members thereof. The wooden back portion has hook and loop surface disposed on a front surface thereof. A plurality of letters are provided with each having hook and loop fasteners disposed on a rear surface thereof for mating with the hook and loop surface of the sign portion.

4 Claims, 2 Drawing Sheets

OUTDOOR ADVERTISING SIGN

BACKGROUND OF THE INVENTION

1. Field of the Invention

The present invention relates to changeable letter signs and more particularly pertains to a new outdoor advertising sign for displaying advertising letters in a secure manner.

2. Description of the Prior Art

The use of changeable letter signs is known in the prior art. More specifically, changeable letter signs heretofore devised and utilized are known to consist basically of familiar, expected and obvious structural configurations, notwithstanding the myriad of designs encompassed by the crowded prior art which have been developed for the fulfillment of countless objectives and requirements.

Known prior art changeable letter signs include U.S. Pat. No. 4,888,893 to Jones; U.S. Pat. No. 4,710,979 to Bull et al.; U.S. Pat. No. 5,065,537 to Bailey; U.S. Pat. No. 5,029,406 to Hofman; U.S. Pat. No. 4,014,118 to Robinet et al.; and U.S. Pat. No. Des. 284,589 to James.

While these devices fulfill their respective, particular objectives and requirements, the aforementioned patents do not disclose a new outdoor advertising sign. The inventive device includes a sign portion including a wooden back portion. The wooden back portion has a metal peripheral frame secured around an outer periphery thereof. The metal peripheral frame has incremental markings on opposed side members thereof. The wooden back portion has hook and loop surface disposed on a front surface thereof. A plurality of letters are provided with each having hook and loop fasteners disposed on a rear surface thereof for mating with the hook and loop surface of the sign portion.

In these respects, the outdoor advertising sign according to the present invention substantially departs from the conventional concepts and designs of the prior art, and in so doing provides an apparatus primarily developed for the purpose of displaying advertising letters in a secure manner.

SUMMARY OF THE INVENTION

In view of the foregoing disadvantages inherent in the known types of changeable letter signs now present in the prior art, the present invention provides a new outdoor advertising sign construction wherein the same can be utilized for displaying advertising letters in a secure manner.

The general purpose of the present invention, which will be described subsequently in greater detail, is to provide a new outdoor advertising sign apparatus and method which has many of the advantages of the changeable letter signs mentioned heretofore and many novel features that result in a new outdoor advertising sign which is not anticipated, rendered obvious, suggested, or even implied by any of the prior art changeable letter signs, either alone or in any combination thereof.

To attain this, the present invention generally comprises a sign portion including a wooden back portion. The wooden back portion has a metal peripheral frame secured around an outer periphery thereof. The metal peripheral frame has a plurality of legs extending downwardly therefrom. The metal peripheral frame has incremental markings on opposed side members thereof. The incremental markings extend from an upper end to a lower end of the frame. The wooden back portion has hook and loop surface disposed on a front surface thereof. A plurality of letters are provided with each having hook and loop fasteners disposed on a rear surface thereof for mating with the hook and loop surface of the sign portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new outdoor advertising sign apparatus and method which has many of the advantages of the changeable letter signs mentioned heretofore and many novel features that result in a new outdoor advertising sign which is not anticipated, rendered obvious, suggested, or even implied by any of the prior art changeable letter signs, either alone or in any combination thereof.

It is another object of the present invention to provide a new outdoor advertising sign which may be easily and efficiently manufactured and marketed.

It is a further object of the present invention to provide a new outdoor advertising sign which is of a durable and reliable construction.

An even further object of the present invention is to provide a new outdoor advertising sign which is susceptible of a low cost of manufacture with regard to both materials and labor, and which accordingly is then susceptible of low prices of sale to the consuming public, thereby making such outdoor advertising sign economically available to the buying public.

Still yet another object of the present invention is to provide a new outdoor advertising sign which provides in the apparatuses and methods of the prior art some of the advantages thereof, while simultaneously overcoming some of the disadvantages normally associated therewith.

Still another object of the present invention is to provide a new outdoor advertising sign for displaying advertising letters in a secure manner.

Yet another object of the present invention is to provide a new outdoor advertising sign which includes a sign portion including a wooden back portion. The wooden back portion has a metal peripheral frame secured around an outer periphery thereof. The metal peripheral frame has incremental markings on opposed side members thereof. The wooden back portion has hook and loop surface disposed on a front surface thereof. A plurality of letters are provided with each having hook and loop fasteners disposed on a rear surface thereof for mating with the hook and loop surface of the sign portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
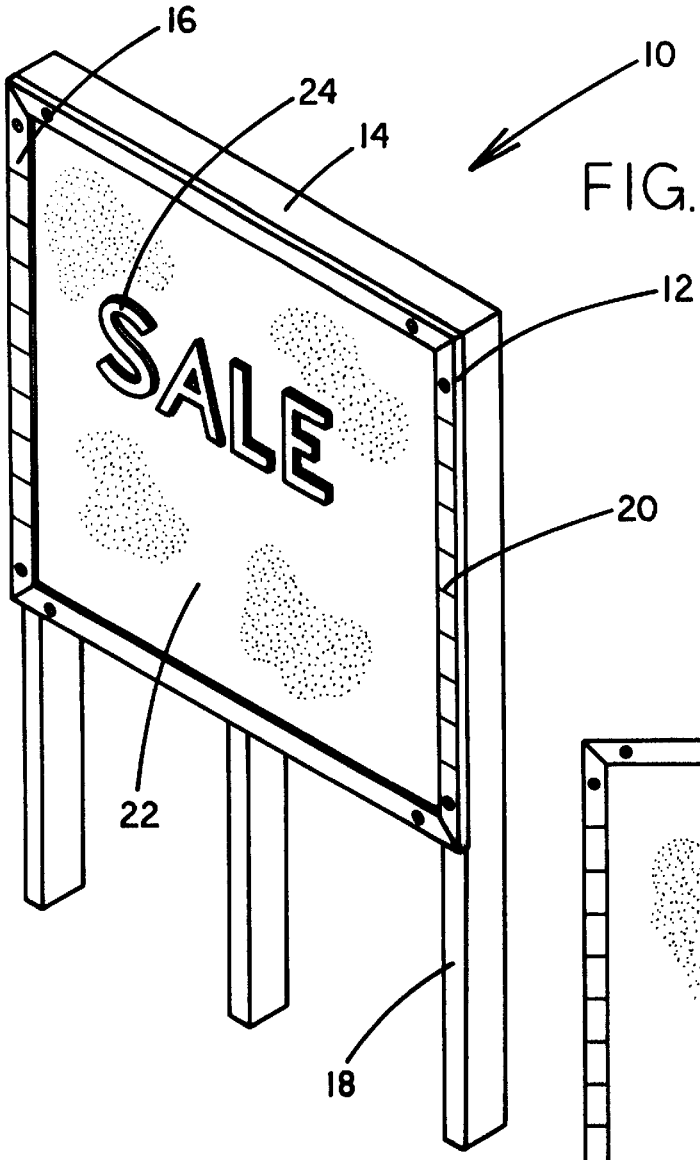
FIG. 1 is a perspective view of a new outdoor advertising sign according to the present invention.
Figure 2:
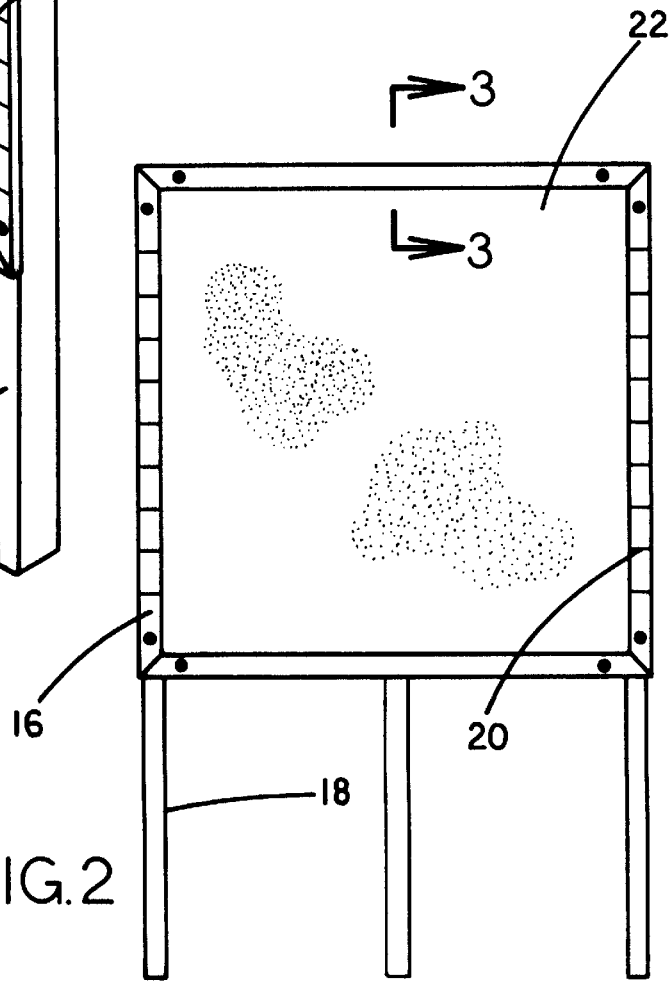
FIG. 2 is a front view of the present invention.
Figure 3:
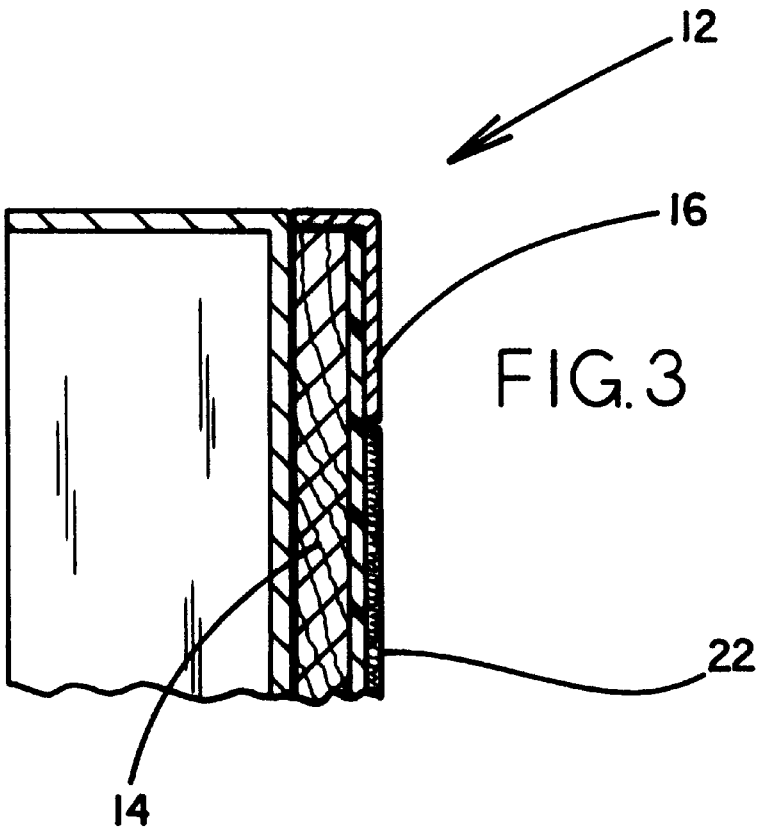
FIG. 3 is a cross-sectional view of the present invention as taken along line 3—3 of FIG. 2.
Figure 4:
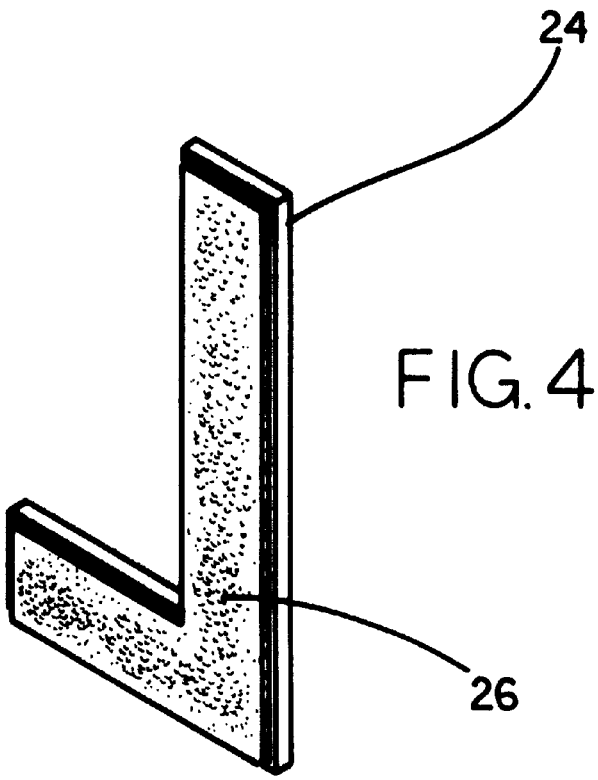
FIG. 4 is a rear perspective view of one of the letters of the present invention.

With reference now to the drawings, and in particular to FIGS. 1 through 4 thereof, a new outdoor advertising sign embodying the principles and concepts of the present invention and generally designated by the reference numeral 10 will be described.

As best illustrated in FIGS. 1 through 4, the outdoor advertising sign 10 comprises a sign portion 12 including a wooden back portion 14. The wooden back portion 14 has a metal peripheral frame 16 secured around an outer periphery thereof. The metal peripheral frame 16 has a plurality of legs 18 extending downwardly therefrom. The plurality of legs 18 will support the sign portion 12 in an upright orientation. The plurality of legs 18 could be incorporated with spiked lower ends in order to penetrate a ground surface. The metal peripheral frame 16 has incremental markings 20 on opposed side members thereof. The incremental markings 20 extend from an upper end to a lower end of the frame 16. The incremental markings 20 would allow for the user to align letters to be placed on the sign portion 12 so that the letters are presented in a neat and organized manner. The wooden back portion 14 has hook and loop surface 22 disposed on a front surface thereof.

A plurality of letters 24 are provided with each having hook and loop fasteners 26 disposed on a rear surface thereof for mating with the hook and loop surface 22 of the sign portion 12. The plurality of letters 24 can be provided in a variety of sizes. Numbers and other symbols could be incorporated into the present invention.

In use, the present invention will provide a sign that has interchangeable letters 24 utilizing hook and loop fasteners 26 for their securement to the sign portion 12. The letters 24 can be placed anywhere on the hook and loop surface 22 of the sign portion 12 as compared to the traditional plastic retaining ribs, which allow only set rows of letters to be placed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An outdoor advertising sign for displaying advertising letters in a secure manner comprising, in combination:

a sign portion including a back portion, the back portion having a metal peripheral frame, said peripheral frame being secured around an outer periphery of the back portion, the metal peripheral frame having a top member and a bottom member, the top and bottom members being positioned in substantially parallel spaced relationship to each other, the frame further having a pair of side members positioned on opposite sides of the frame and extending between the top and bottom members, each of the side members having a substantially planar front face, each said front faces having incremental markings, the incremental markings being oriented substantially parallel to the top and bottom members and aligned with an associated one of the markings on the opposite side member for facilitating alignment of items placed on the back portion, the back portion having hook and loop surface disposed on a front surface thereof;

wherein the incremental markings are positioned in spaced relationship to each other to extend from an upper end to a lower end of each respective side member of the frame; and wherein the metal peripheral frame has a pair of outer legs extending downwardly from opposite ends of the bottom member of the frame and a central leg extending downwardly from a medial portion of the bottom member of the frame; and a plurality of letters each having hook and loop fasteners disposed on a rear surface thereof for mating with the hook and loop surface of the sign portion.

2. An outdoor advertising sign for displaying advertising letters in a secure manner comprising, in combination: the a sign portion including a back portion, the back portion having a metal peripheral frame, said peripheral frame being secured around an outer periphery of the back portion, the metal peripheral frame having a top member and a bottom member, the top and bottom members being positioned in substantially parallel spaced relationship to each other, the frame further having a pair of side members positioned on opposite sides of the frame and extending between the top and bottom members, each of the side members having a substantially planar front face, each said front faces having incremental markings, the incremental markings being oriented substantially parallel to the top and bottom members and aligned with an associated one of the markings on the opposite side member for facilitating alignment of items placed on the back portion, the back portion having hook and loop surface disposed on a front surface thereof; and a plurality of letters each having hook and loop fasteners disposed on a rear surface thereof for mating with the hook and loop surface of the sign portion.

3. The outdoor advertising sign as set forth in claim 2 wherein the incremental markings are positioned in spaced relationship to each other to extend from an upper end to a lower end of each respective side member of the frame.

4. The outdoor advertising sign as set forth in claim 2 wherein the metal peripheral frame has a plurality of legs extending downwardly therefrom.

* * * * *